United States Patent [19]

Copeland

[11] Patent Number: 4,572,081

[45] Date of Patent: Feb. 25, 1986

[54] CONVERTIBLE DINING TABLE AND WORK COUNTER

[76] Inventor: Timothy E. Copeland, Star Rte., P.O. Box 386, Corinth, Vt. 05033

[21] Appl. No.: 445,782

[22] Filed: Dec. 1, 1982

[51] Int. Cl.[4] ..... A47B 85/00

[52] U.S. Cl. ..... 108/17; 108/11; 108/71; 108/112

[58] Field of Search ..... 108/11, 17, 76, 80, 108/81, 71, 69, 112; 312/21, 282

[56] References Cited

U.S. PATENT DOCUMENTS

| | | | |
|---|---|---|---|
| 786,732 | 4/1905 | Crandall | 108/112 |
| 2,035,718 | 3/1936 | Perl | 108/80 |
| 2,649,137 | 8/1953 | Roberts | 108/71 X |
| 3,688,705 | 9/1972 | Barabas | 108/17 |

FOREIGN PATENT DOCUMENTS

| | | | |
|---|---|---|---|
| 267176 | 3/1927 | United Kingdom | 108/17 |

*Primary Examiner*—William E. Lyddane
*Assistant Examiner*—Peter A. Aschenbrenner
*Attorney, Agent, or Firm*—Sughrue, Mion, Zinn, Macpeak & Seas

[57] ABSTRACT

A rectangular open box frame supports a raisable tabletop center panel to which side leaves are hinged at the side. Levers hinge connect the side panels to the box frame. Pins projecting vertically downwardly from the bottom of the table center panel engage the box frame such that the table top center panel is raised and lowered and maintained horizontal, being driven by the hinged table leaves to form a raised center panel work counter of limited width or a dining table of reduced table height but with the end leaves pivoted to horizontal position coplanar with the tabletop center panel to increase the tabletop surface area.

4 Claims, 4 Drawing Figures

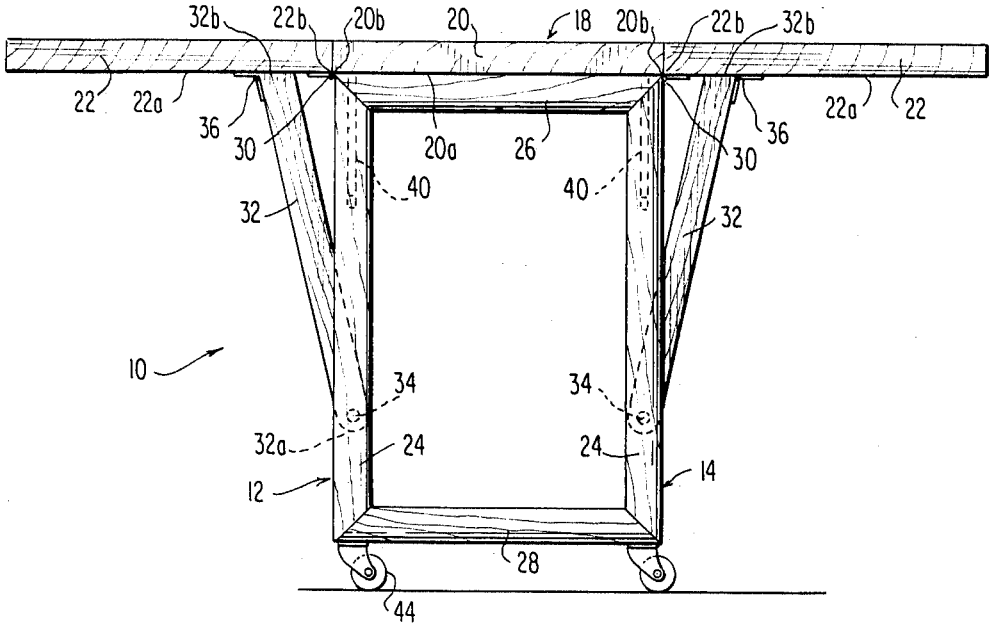
FIG. 2
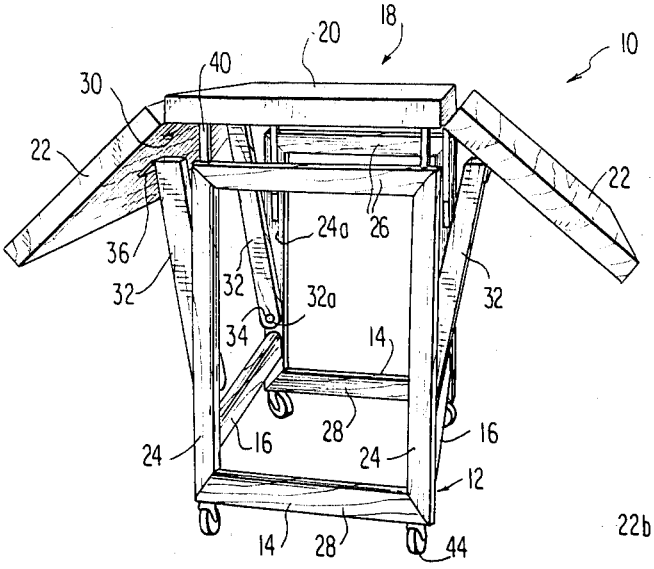
FIG. 1
FIG. 3
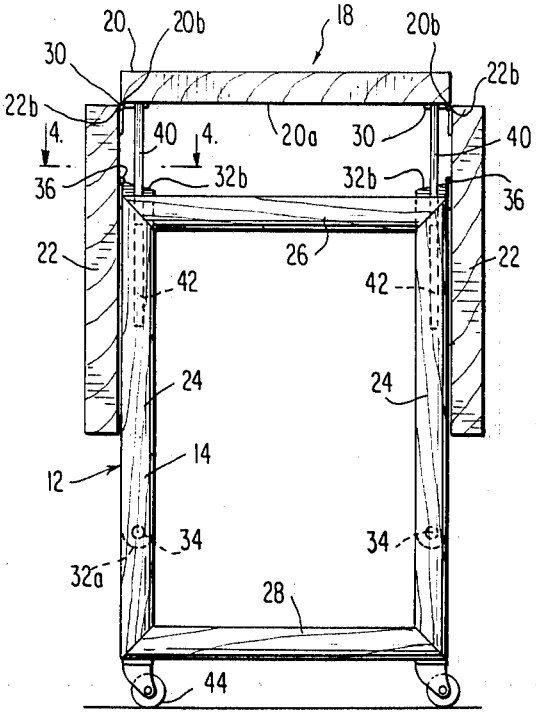
FIG. 4
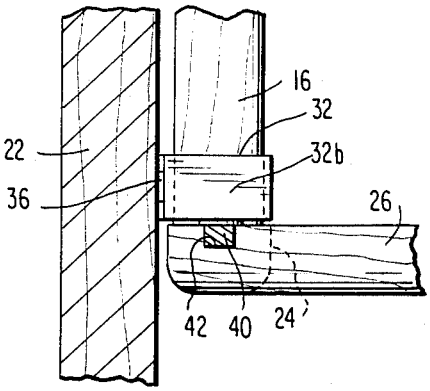

CONVERTIBLE DINING TABLE AND WORK COUNTER

FIELD OF THE INVENTION

This invention relates to a raised height work counter and, more particularly to such a counter which converts to a lower height dining table of increased tabletop surface area.

BACKGROUND OF THE INVENTION

In apartments and the like, space is at a premium. Attempts have been made to make certain pieces of furniture serve multiple purposes. Difficulties have arisen where tables are employed in the performance of several functions. For instance, as may be appreciated, standard height dining tables permit the serving of meals on the tabletop at a height principally dictated by the seat height of the chairs surrounding the table. However, when working in the kitchen, a housewife operates adjacent fixed work counters whose countertops are at a greater height which does not require the housewife to bend over to perform culinary functions.

It is, therefore, a primary object of the present invention to provide a unitary piece of furniture which constitutes both a dining table with the tabletop at a lower eating position and a work counter with the top raised to a higher work level position to permit a person standing in front of the piece of furniture to comfortably work at their increased height.

It is a further object of the present invention to provide an improved convertible work counter which is simplified, is pleasing to the eye, and one in which the tabletop takes two two bistable positions effected through gravity action and overcenter pivoting.

SUMMARY OF THE INVENTION

A convertible dining table and work counter is comprised of a box frame or base formed by vertical rectangular open end frames having longitudinal stringers therebetween fixedly joined at their ends to respective end frames. A central tabletop panel with a width corresponding to the width of the open end frames overlays the box frame, extending therebetween. End panels or end leaves are edge hinged to the center panel along the side edges of the center panel. Levers are hinged to the box frame at one end and to the end leaves at their other ends at positions outboard of the hinge connection between the center panel and the end panel. The levers are of such a length that with the end leaves extending generally vertically downward from the sides of the open box frame, the center panel is raised above the box frame. The center panel is lowered onto the top of the box frame by pivoting the end leaves coplanar to the center panel to provide an increased tabletop surface area at dining table height. Guide means are provided for limiting movement of the center panel relative to the box frame to vertical raising and lowering of that center panel.

Preferably guide pins project downwardly from beneath the center panel at points in line with and engaging the box frame. Dados may be found on opposed facing surfaces of the vertical uprights of the end frames to receive and guide the pins. The end frames may be joined together at their bottoms by lower stringers only, permitting levers to be hinged to each riser of the rectangular open end frame at their bottoms for movement into in line position therewith during raising of the center panel and movement of the end panels to vertical side-by-side position with respect to the end frame risers. The position of the hinge connections for the levers relative to the end panels may be such that the levers pivot to slight overcenter position across the risers during closing of the end leaves to insure retention of the end leave against the side of the table box frame. The end leaves may be latched to the center panel when in raised horizontal position to maintain coplanar position of the end leaves with respect to the center panel.

BRIEF DESCRIPTION OF THE DRAWINGS

FIG. 1 is a perspective view of the covertible dining table and work counter forming a preferred embodiment of the present invention.

FIG. 2 is an end elevational view of the embodiment of FIG. 1 in dining table form.

FIG. 3 is a similar end elevational view of the embodiment of FIG. 1 as converted to a work counter.

FIG. 4 is a sectional view of a portion of the unit taken about line 4—4 of FIG. 3.

DESCRIPTION OF THE PREFERRED EMBODIMENT

Referring to the drawings, a convertible dining table and work counter or unit is indicated generally at 10 and forms a preferred embodiment of the present invention. The unit is comprised principally of a rectangular open box frame or base indicated generally at 12 and a tabletop indicated generally at 18. Tabletop 18 is formed of a center panel 20 which is of elongated rectangular form and a pair of end panels or end leaves 22 also of elongated rectangular form and being hinge connected to the sides of the center panel 20. The rectangular open box frame 12 consists of a pair of longitudinally spaced rectangular open end frames 14 joined together near their bottoms by means of stringers 16. Stringers 16 have their ends pinned by means of pins (not shown) to the lower ends of end frame risers 24 of inside faces **24*a*. The end frame risers 24 are joined at their upper ends by horizontal upper crosspieces 26 and are similarly joined at the bottom by lower crosspieces 28. Conventional metal hinges 30 attached by screws or the like to the bottom surface 20*a* along both edges 20*b* of the center panel 20 and at opposite longitudinal ends to the center panel. In turn, the hinges 30 are screwed to bottom 22*a*, along edges 22*b*, of the end panels 22** at corresponding positions.

To effect conversion from a dining table form or configuration to that of a work counter, a number of conversion levers 32 are provided. The conversion levers 32 are (as all the major members of the dining table and work counter unit) formed of wood. In this case beams of rectangular cross-section are employed, each having a rounded lower end at **32*a* and a beveled upper end at 32*b*. Pivot pins 34 which mount to the inside surfaces 24*a* of the risers 24 of the open end frames 14, pivotably connect the lowers ends 32*a* of the conversion levers 32 to the risers. At their upper ends 32*b*, hinges 36 are mounted by screws to the conversion levers and the bottom surface 20*a*, pivotably connecting the conversion levers 32 to center panel 20. The length of the conversion levers 32 and the position of their pivot connections to risers 24 and to the end leaves 22 insure that when the end leaves are raised to horizontal position such that they are coplanar with the horizontal center panel 20 they function as extensions to the tabletop center panel 20. Center panel 20 has its bottom surface 20***a* resting on top of the end frame crosspieces 26 under this condition. Further, the hinge position of the conversion levers to the table leaves is such that, as end panels or leaves 22 are lowered, that is, pivoted from a horizontal orientation to a vertical orientation, the center panel 20 is raised above the top of the rectangular open box frame 12 to a conventional work counter height. Thus, the unit converts from a dining table with the table top at a lower, conventional dining table height to a work counter with the center panel in horizontal position raised to work counter height. The change may be readily appreciated by viewing FIGS. 1, 2 and 3 and particularly contrasting FIGS. 2 and 3.

It is necessary to employ some type of guide means limiting and guiding the center panel 20 in its movement vertically, that is, raising it above and lowering it onto the top of the rectangular open box frame 12. In the illustrated embodiment, the guide means comprises a plurality of vertical guide pins 40 which project downwardly from the bottom surface 20*a* of the center panel 20. The pins 40 are of a suitable vertical length so as to insure contact with at least the end frame risers 24. Risers 24 bear slots or grooves and specifically in the illustrated embodiment, FIG. 4, dados 42 which extend through the end frame crosspieces 26 and downwardly into the end frame risers 24 at their tops to the extent necessary to permit retraction and extension of the guide pins 40 during raising the lowering of the center panel 20 and pivoting of the end leaves from vertical position to horizontal position and vice versa.

Rather than using the three sided dado holes 42, rectangular or circular holes may be drilled or otherwise formed fully within the upper end frame crosspieces 26 internally of the end frame risers 24. It is envisioned that a single guide pin may be employed at each end of the center panel for guiding the center panel 20 during its rising and lowering relative to the rectangular open box frame 12.

The lower crosspieces 28 may rest directly on the floor of the building housing the convertible dining table and work counter. Alternatively, as shown, suitable casters may be employed as at 44 mounted to the end frame lower crosspieces 28 at the ends thereof and underlying the end frame vertical risers 24.

It should be appreciated that the weight of the table end panels or end leaves when in vertical position will tend to maintain the center panel in raised horizontal position and thus at work counter height. Additionally and purposely, in this embodiment, the conversion lever pivots to a slight overcenter position, that is, just through a position crossing the vertical risers of the open end frames 14 as the center panel rises to its highest vertical position. Additionally, the center panel under gravity force tends to fall downwardly to the point its bottom surface contacts the end frame upper crosspieces 26 with the weight of the center panel tending to drive the end panels or end leaves outwardly and upwardly into coplanar horizontal position with the center panel to each side thereof as the unit converts from the work counter configuration to dining table form and with the tabletop center panel in lowered position.

While the invention has been particularly shown and described with reference to a preferred embodiment thereof, it will be understood by those skilled in the art that various changes in form and details may be made therein without departing from the spirit and scope of the invention.

What is claimed is:

1. A convertible dining table and work counter comprising:

a tabletop, a table base underlying said tabletop, said base including longitudinally spaced laterally separated paired vertical risers, a laterally extending crosspiece joining paired vertical risers at each end and underlying said tabletop, said tabletop comprising a center panel of a width generally corresponding to the base and extending longitudinally thereof with its ends overlying lateral crosspieces, end leaves edge hinged to the center panel along the side edges of the center panel so as to pivot vertically downwardly from the side edges of the center panel, conversion levers hinged at one end to the base and having the other end hinged to the end leaves at positions outwardly of the hinge connection of said end leaves to said center panel, the hinge connections of the conversion levers and the length of said conversion levers being such that with the end leaves extending generally vertically downwardly from the side edges of the center panel, the center panel is raised above the crosspiece to counter height, and wherein by pivoting the end leaves coplanar to the center panel, the center panel is lowered onto the crosspieces to provide an increased tabletop surface area at reduced table height, and guide means for permitting vertical raising and lowering of the center panel while preventing lateral and longitudinal movement of the center panel relative to the base.

2. The convertible dining table and work counter as claimed in claim 1, wherein said table base comprises a box frame formed by vertical rectangular open end frames with longitudinal stringers fixedly joined at their ends to respective end frames and extending longitudinally therebetween and wherein said vertical risers are joined at their bottoms by a second lateral crosspiece to complete said vertical rectangular open end frames at each end of said table base.

3. The convertible dining table and work counter as claimed in claim 2, wherein said guide means comprises pins fixedly mounted to and depending from the bottom of the center panel in line with the vertical rectangular open end frames and holes projecting at least within said lateral crosspieces underlying the tabletop center panel and receiving said guide pins so as to guide the center panel during its vertical raising and lowering relative to said rectangular open end frames.

4. The convertible dining table and work counter as claimed in claim 3, wherein said holes comprise dados formed on opposed facing surfaces of said crosspieces at vertical risers and extending into said risers so as to hide guide pins aligned therewith and received therein when the center panel is lowered into contact with the lateral crosspieces of the table base.

* * * * *